US007236716B2

(12) United States Patent
Ishino et al.

(10) Patent No.: US 7,236,716 B2
(45) Date of Patent: Jun. 26, 2007

(54) IMAGE FORMATION DEVICE HAVING A FIXING APPARATUS PLACED ON A HEAT-SHIELDING MEMBER

(75) Inventors: Masahiro Ishino, Iwatsuki (JP); Mikio Saiki, Iwatsuki (JP); Masami Ishida, Iwatsuki (JP); Yoshiyasu Tanioka, Iwatsuki (JP); Hiroshi Daigo, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 199 days.

(21) Appl. No.: 11/058,271

(22) Filed: Feb. 16, 2005

(65) Prior Publication Data

US 2006/0018679 A1 Jan. 26, 2006

(30) Foreign Application Priority Data

Jul. 20, 2004 (JP) ..... 2004-211943

(51) Int. Cl.
*G03G 15/20* (2006.01)
*G03G 21/20* (2006.01)

(52) U.S. Cl. ..... 399/94; 399/122

(58) Field of Classification Search ..... 399/92, 399/94, 122

See application file for complete search history.

(56) References Cited

U.S. PATENT DOCUMENTS

| | | | | |
|---|---|---|---|---|
| 6,021,290 | A * | 2/2000 | Hamada et al. | 399/92 |
| 6,240,265 | B1 * | 5/2001 | Noh | 399/92 |
| 6,327,447 | B1 * | 12/2001 | Nakano et al. | 399/92 |
| 6,415,118 | B1 * | 7/2002 | Setoriyama et al. | 399/92 |
| 6,445,892 | B1 * | 9/2002 | Kelsay | 399/94 |
| 6,754,458 | B2 * | 6/2004 | Makihira | 399/92 |
| 6,922,538 | B2 * | 7/2005 | Kimura | 399/94 |
| 7,003,242 | B2 * | 2/2006 | Kida | 399/92 |

FOREIGN PATENT DOCUMENTS

| | | |
|---|---|---|
| JP | 2001-255703 | 8/2001 |
| JP | 3298354 | 4/2002 |

* cited by examiner

*Primary Examiner*—William J. Royer
(74) *Attorney, Agent, or Firm*—Sughrue Mion, PLLC

(57) ABSTRACT

An image formation device is provided, at which a fixing apparatus is disposed inside a housing of a printer main body, and which is configured in a fanless ventilation structure. This image formation device is provided with: a fixing unit mounting portion positioned at an upper portion of the housing, and surrounded by a partition wall and a heat-shielding member extending from a side face of the partition wall, the fixing apparatus being placed on the heat-shielding member, and the fixing unit mounting portion being isolated such that hot air will not flow to equipment inside the housing; a cover member for covering the fixing unit mounting portion; a ventilation portion which includes ventilation apertures formed through the cover member; and a conveyance portion for the recording medium.

18 Claims, 6 Drawing Sheets

IMAGE FORMATION DEVICE HAVING A FIXING APPARATUS PLACED ON A HEAT-SHIELDING MEMBER

CROSS-REFERENCE TO RELATED APPLICATION

This application claims priority under 35 USC 119 from Japanese patent application, No. 2004-211943, the disclosure of which is incorporated by reference herein.

BACKGROUND OF THE INVENTION

1. Field of the Invention

The present invention relates to an image formation device equipped with a fixing apparatus which is employed in a copying device, printer or the like, which is structured to serve as an electrophotography system.

2. Description of the Related Art

Commonly, in an image formation device such as a copying device, a printer or the like that employs an electrophotography system, a photosensitive body formed in, for example, a drum shape is uniformly charged, the photosensitive body is exposed with light which is controlled in accordance with image information, and an electrostatic latent image is formed on the photosensitive body. Hence, this electrostatic latent image is made visible with toner (a toner image), and this toner image is transferred to recording paper and is fixed by a fixing apparatus, for image formation.

Among electrophotography-system image formation devices, there are color image formation devices which form full-color images. These color image formation devices are of, broadly speaking, a type which employs an intermediate transfer body and a type which does not employ an intermediate transfer body. An image formation device which employs an intermediate transfer body has the advantage, because toner images formed on the photosensitive body are temporarily primary-transferred onto the intermediate transfer body, of being able to implement primary-transfer without regard to the material of a recording medium, thus improving image quality of full-color images.

Further, among color image formation devices which employ an intermediate transfer body, there are devices of a "four-cycle" system and devices of a "tandem" system. A color image formation device of the four-color system primary-transfers toner images of each of the colors, such as yellow, magenta, cyan and black, or the like, which are formed sequentially on a single photosensitive body, onto an intermediate transfer body in a state in which the toner images are superposed with one another. The device then secondary-transfers the yellow, magenta, cyan and black (or whatever colors) toner images, which have been superposedly transferred onto the intermediate transfer body, onto a recording medium with a secondary transfer roller. Thus, a color image is formed.

On the other hand, a color image formation device of the tandem system forms toner images of mutually different colors, such as yellow, magenta, cyan and black, or the like, on plural (for example, four) photosensitive bodies and primary-transfers these toner images onto an intermediate transfer body in a state in which the toner images are superposed with one another. Then, the device secondary-transfers the yellow, magenta, cyan and black (or whatever colors) toner images, which have been superposedly transferred onto the intermediate transfer body, onto a recording medium with a secondary transfer roller. Thus, this structure forms a color image.

A fixing apparatus, which is employed in an image formation device of the various systems described above, passes recording paper bearing an unfixed toner image between, for example, a fixing roller and a pressure roller, and fixes the toner image to the recording paper by applying heat and pressure to the unfixed toner image.

With regard to fixing apparatuses for such electrophotography systems, schemes to raise fixing speed, improve image quality by preventing occurrences of fixing unevenness and paper creasing, reduce the size of a fixing apparatus, and shorten a warm-up time of a fixing apparatus, from room temperature up to a state in which fixing processing is possible, have been called for.

Accordingly, in response to such requests, realization of a fixing apparatus known as a free belt nip fuser has been attempted. A free belt nip fuser is a structure in which a fixing belt is slidably disposed on a surface of a pressure pad, which is fixed in place, a belt nipping width is broadened, and the fixing belt is pressed by a heating roller such that an exit side of the sheet is locally formed as an elastically deformed fixing surface.

At a free belt nip fuser with such a structure, a sheet to which a toner image has been transferred is nipped between the fixing belt and the heating roller, which is driven to rotate, and is operated to turn together with the fixing belt. At the same time, the toner image is fixed by a heating and pressing operation while the sheet is passing the fixing surface. Hence, the sheet is peeled from the fixing belt and ejected.

With this free belt nip fuser, it is possible to achieve an increase in nipping width of the belt, an increase in speed of the fixing process, and a reduction in size of the fixing apparatus. It is also possible to achieve a reduction in amounts of beat lost from the heating roller to the fixing belt and pressure pad side, a reduction in amounts of temperature lowering at a nipping region of the belt, an increase in efficiency of utilization of heat in fusing of the toner, an improvement in fixing characteristics of the toner and a shortening of warm-up times (see, for example, Japanese Patent No. 3,298,354).

At such a fixing apparatus, in order to carry out fixing processing by heating and pressing a sheet to which a toner image has been transferred while the sheet is being conveyed by the nipping region, the heating roller is heated to a high temperature which is required for fixing. Consequently, heat from the heating roller that has been heated to the high temperature is spread to the surroundings, hot air passes through the interior of a housing of an image formation device, inside which housing the fixing apparatus is disposed, and there is a risk of a developing apparatus, an exposure apparatus and so forth inside, the housing being heated to high temperatures and suffering adverse effects. Accordingly, image formation devices which are equipped with these fixing apparatuses commonly have structures in which an exhaust fan is provided at a vicinity in which the fixing apparatus is disposed and the exhaust fan forcibly exhausts hot air from an exhaust outlet, which is formed through the housing.

However, when hot air is forcibly exhausted from an exhaust outlet by an exhaust fan disposed near a fixing apparatus in this manner, there is a problem in that the hot air which is, being continuously exhausted in a certain direction from the exhaust outlet carries a bad odor. Thus, people who are stationed in a vicinity of the exhaust outlet near the fixing apparatus in the image formation device, people passing through this vicinity and the like experience unpleasant odors. Furthermore, there are problems in that, if an exhaust fan disposed near a fixing apparatus is continuously operated to forcibly exhaust hot air from an exhaust outlet, the air exhaust operation of the exhaust fan is accompanied by emissions of continuous noise. Moreover, amounts of energy consumed for continuously operating the exhaust fan are large, and the image formation device is increased in cost by an amount corresponding to the exhaust fan.

SUMMARY OF THE INVENTION

In consideration of the problems described above, the present invention provides a low-cost image formation device with which the generation of noise such as air exhaust noise and the like is eliminated, by hot air that is spread from a fixing apparatus being dispersed to outside a housing and released without an exhaust fan being employed in a vicinity of the fixing apparatus.

An image formation device of a first aspect of the present invention is an image formation device at which a fixing apparatus that heats and pressures a recording medium, which bears a toner image, for fixing the toner image is disposed inside a housing of a printer main body and is configured in a fanless ventilation structure, the image formation device including: a fixing unit mounting portion, which is structured at an inner side of a corner portion along one side of an upper portion of the housing is surrounded by a partition wall and a heat-shielding member, which is oriented so as to extend from a side face of the partition wall, the fixing apparatus being placed on the heat-shielding member, and is isolated such that hot air will not flow to equipment inside the housing; a cover member for covering the fixing unit mounting portion, the cover member structuring an exterior form corresponding to the corner portion along the one side of the upper portion of the housing; ventilation apertures formed through at least an upper portion and a lower portion of the cover member to span ranges which respectively correspond to a whole length of the fixing apparatus in a length direction thereof; and a conveyance path for the recording medium, which is provided in a vicinity of a conveyance path-facilitating portion, which is a portion of one side of the heat-shielding member.

In a fanless ventilation structure image formation device with a structure as described above, the characteristic of hot air rising is utilized. The fixing apparatus is cooled by air that has entered through all the ventilation apertures at the lower portion of the cover member being subjected to heat exchange across the whole length direction length of the fixing apparatus. Hence, the warmed air rises and is exhausted uniformly from all the ventilation apertures formed in the upper portion of the cover member. Thus, natural ventilation of air in an interior portion, which is surrounded by the partition wall, the heat-shielding member and the cover member, such that efficiency of flow of the air is good can be achieved. In addition, in this fanless exchange structure image formation device, an airflow which is generated to span the whole of a width direction of the recording medium, in accordance with an operation of conveyance of the recording medium that is to be fixing-processed by the fixing apparatus along the conveyance path, contacts and cools the fixing apparatus across the length direction thereof. Hence, the warmed air rises and is efficiently exhausted uniformly from all of the ventilation apertures that are formed in the upper portion of the cover member to span the length direction of the fixing apparatus. As a result, it is possible to eliminate the necessity for provision of an exhaust fan in the image formation device, to eliminate the generation of noise such as exhaust noise and the like, to cut out a number of components relating to an exhaust fan, and to provide a product whose cost is lower by an amount corresponding to the cost of an exhaust fan. Furthermore, when air that has been employed for cooling the fixing apparatus disposed in the interior portion surrounded by the partition wall, the heat-shielding member and the cover member is being ventilated, the air that is exhausted from the interior portion is heated and includes noxious components generated during heating and fixing of toner. However, this air is dispersed uniformly and exhausted from all the ventilation apertures spanning the length direction of the fixing apparatus. Thus, this air is promptly mixed with air outside the cover member and the noxious components are rapidly dispersed and diluted. Therefore, it is possible to avoid the sensing of bad odors in the area of this image formation device.

An image formation device of a second aspect of the present invention is an image formation device at which a fixing apparatus which heats and pressurizes a recording medium, which bears a toner image, for fixing the toner image is provided as a fixing unit, which is removable from a printer main body, inside a housing of the printer main body, the image formation device including: a cover member which structures a portion of the housing and covers an upper face side of the fixing unit and one side face side of the fixing unit; apertures formed in each of the upper face side and one side face side of the cover member to span a length direction of the fixing unit; a shielding portion which is formed to span from a lower face side of the fixing unit to another side face side of the fixing unit, which is opposite from the one side face side thereof, and forms a partition wall inside the housing of the printer main body; and a passage portion which allows the recording medium to pass through from below to above the fixing unit.

With a structure as described above, because the fixing apparatus is structured as a unit, directions of hot air spreading from the fixing apparatus are limited to predetermined directions by an exterior component of the unit itself, and the shielding portion, which is formed to extend from the lower face side of the fixing unit to the other side face side of the fixing unit, further limits directions of hot air being spread from the fixing apparatus. Thus, it is possible to limit directions of hot air being spread from the fixing unit. Furthermore, the apertures are formed in the cover member at the upper face side of the fixing unit and the one side face side of the fixing unit, which oppose the shielding portion. In addition, because the recording medium passes through the fixing unit from below to above, a direction in which the hot air is turned by the shielding portion, a direction in which the hot air is dispersed by natural convection and a direction of tensioning of the recording medium in a conveyance direction are the same direction. Thus, it is possible to release the hot air to outside the housing efficiently, without employing an exhaust fan in the vicinity of the fixing apparatus. Moreover, completely fanless ventilation in which exhaust fans are completely eliminated from the printer main body is possible.

An image formation device of a third aspect of the present invention includes: a housing which structures an exterior form of a printer main body; a fixing unit mounting portion which is structured at an inner side of a corner portion along one side of an upper portion of the housing, the fixing unit mounting portion including a partition wall and a heat-shielding member, which extends from a side face of the partition wall; a removable fixing unit which is placed on the heat-shielding member inside the housing, the fixing unit heating and pressurizing a recording member which bears a toner image for fixing the toner image; a cover member which structures a portion of the housing and covers an upper face of the fixing unit and one side face of the fixing unit; a ventilation portion which includes plural apertures formed in each of the upper face and the one side face of the cover member to span a length direction of the fixing unit; and a passage portion which allows the recording medium to pass through from below to above the fixing unit.

According to an image formation device of the present invention, because hot air that spreads from a fixing apparatus is dispersed and released to outside a housing without employing an exhaust fan in a vicinity of the fixing apparatus, there is an advantage in that it is possible to eliminate emissions of noise such as air exhaust noise and the like and to provide a lower cost image formation device.

BRIEF DESCRIPTION OF THE DRAWINGS

An embodiment of the present invention will be described in detail based on the following Figures, wherein.

DETAILED DESCRIPTION OF THE INVENTION

Figure 1:
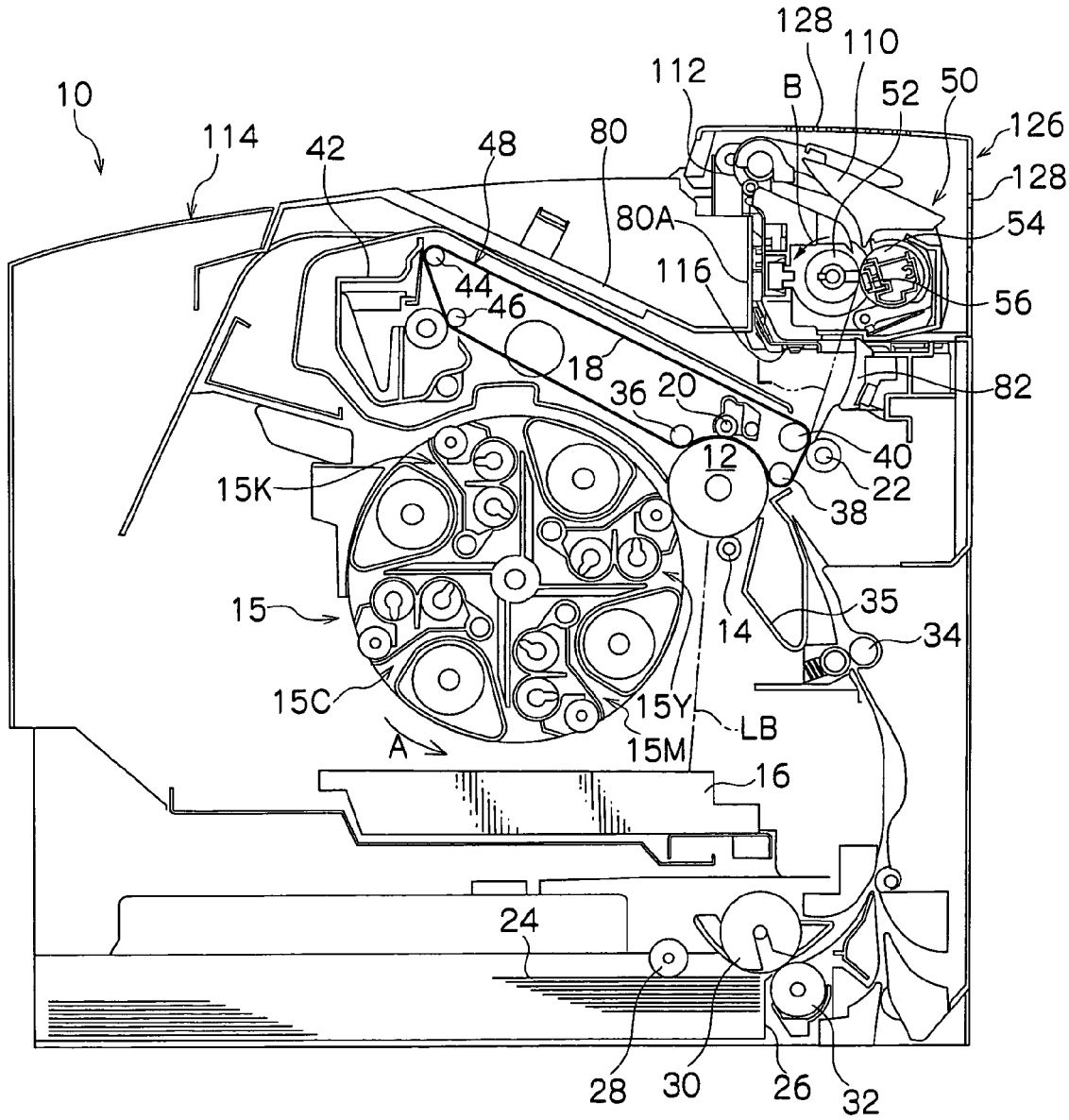
FIG. 1 is a side sectional view of schematic structure of an image formation device relating to an embodiment of the present invention.

An embodiment relating to an image formation device of the present invention will be described in accordance with FIGS. 1 to 6.

A four-cycle system full-color printer serves as an image formation device which is provided with a fixing apparatus for an electrophotography system relating to the present embodiment. In this full-color printer, as shown in the schematic sectional side structural view of FIG. 1, a photosensitive body drum 12 is rotatably provided to serve as an image bearing body, somewhat toward an upper-right portion relative to the middle, of FIG. 1, inside a full-color printer main body 10. The full-color printer main body 10 is configured with a fanless ventilation structure (meaning a completely fanless ventilation structure which is not equipped with any exhaust fans at all in an image formation device main body, or a fanless ventilation structure which is not equipped with an exhaust fan for a fixing unit, in which an exhaust fan is not provided for the purpose of cooling the fixing unit but, for example, a power supply cooling fan is separately provided at a location which is distant from the fixing unit). The photosensitive body drum 12 is structured by, for example, a conductive cylindrical body with a diameter of approximately 47 mm whose surface is covered with a photosensitive layer formed of OPC or the like. The photosensitive body drum 12 is driven to rotate at a certain process speed, of approximately 150 mm/sec, in the opposite direction of arrow A, by unillustrated driving means.

A surface of this photosensitive body drum 12 is charged to a predetermined potential by rotating in contact with a static charging roller 14, which serves as charging means. Thereafter, image exposure is performed by a laser beam (LB) from an ROS (raster output scanner) 16, which serves as exposing means and is disposed at a location separated from and directly below the photosensitive body drum 12. Thus, an electrostatic latent age is formed in accordance with image information.

The electrostatic latent image that has been formed on the surface of the photosensitive body drum 12 is developed by a rotary-type developing apparatus 15, in which developers 15Y, 15M, 15C and 15K, for the colors yellow (Y), magenta (M), cyan (C) and black (K), are arranged along a circumferential direction. Thus, the electrostatic latent image becomes a toner image of a predetermined color. Here, the respective steps of charging, exposure and development are repeated for a predetermined number of times in accordance with colors of an image that is to be formed at the surface of the photosensitive body drum 12.

The developing apparatus 15 is driven to rotate at a predetermined time and the developer 15Y, 15M, 15C or 15K corresponding to a color to be developed is moved to a developing position opposing the photosensitive body drum 12. For example, in a case in which a full-color image is to be formed, the respective steps of charging, exposure and development on the surface of the photosensitive body dram 12 are repeated four times, corresponding to each of the colors yellow (Y), magenta (M), cyan (C) and black (K). Thus, toner images corresponding to each of the colors yellow (Y), magenta (M), cyan (C) and black (K) are sequentially formed on the surface of the photosensitive body drum 12.

A number of rotations of the photosensitive body drum 12 corresponding to the formation of a toner image in this manner differ depending on the size of the image. If, for example, an image is A4 size, the photosensitive body drum 12 rotates three times for formation of a one-color image. Thus, toner images corresponding to the colors yellow (Y), magenta A), cyan (C) and black (K) are sequentially formed on the surface of the photosensitive body drum 12, each with three rotations of the photosensitive body drum 12. Further, when the toner images that are sequentially formed on the photosensitive body drum 12 pass through a primary-transfer position, the toner images are primary-transferred onto an intermediate transfer belt 18 in states such that the toner images are superposed with one another.

The toner images of the colors yellow (Y), magenta (M), cyan (C) and black (K) that are sequentially formed on the photosensitive body drum 12 are primary-transferred red onto the intermediate transfer belt 18 at the primary-transfer position, in the state in which the toner images are superposed with one another, by a primary-transfer roller 20. At the primary-transfer position, the intermediate transfer belt 18, which serves as a belt-form image bearing body (an intermediate transfer body), is wound round an outer periphery of the photosensitive body drum 12. The toner images of yellow (Y), magenta (M), cyan (C) and black (K) which have been superposingly transferred onto the intermediate transfer belt 18 are secondary-transferred all together onto a recording paper 24 by a secondary-transfer roller 22. The recording paper 24 serves as a recording medium, and is supplied at a predetermined time.

This secondary-transfer roller 22 is driven to rotate by an unillustrated drive source via gearing. The recording paper 24 is fed out from a supply section 26, which is disposed at a lower portion of the full-color printer main body 10, by a pickup roller 28, and is supplied in a state in which each sheet is handled individually by a feeding roller 30 and a retarding roller 32. The recording paper 24 is synchronized with the toner images that have been transferred onto the intermediate transfer belt 18 by a registration roller 34. In this state, the recording paper 24 is conveyed to a secondary-transfer position of the intermediate transfer belt 18. The secondary-transfer roller 22 is structured so as to move toward and away from the surface of the intermediate transfer belt 18 at predetermined times.

This intermediate transfer belt 18 is tensioned so as to be stretched by plural rollers and is operated to turn at a certain processing speed (approximately 150 mm/sec) synchronously with the rotation of the photosensitive body drum 12. To be specific, the intermediate transfer belt 18 is tensioned with a predetermined tension by a wrap-in roller 36, the primary-transfer roller 20, a wrapped roller 38, a backup roller 40, a first cleaning backup roller 44 and a second cleaning backup roller 46. The wrap-in roller 36 defines a wrapping position of the intermediate transfer belt 18 at a turning direction upstream side of the photosensitive body drum 12. The primary-transfer roller 20 transfers the toner images that have been formed on the photosensitive body drum 12 onto the intermediate transfer belt 18. The wrapped roller 38 defines a wrapping position of the secondary-transfer roller 22 at a downstream side relative to the wrapping position of the wrap-in roller 36. The backup roller 40 abuts against the secondary-transfer roller 22 with the intermediate transfer belt 18 interposed therebetween. The first cleaning backup roller 44 and the second cleaning backup roller 46 oppose a cleaning apparatus 42 for cleaning of the intermediate transfer belt 18.

Further, in the full-color printer main body 10, the intermediate transfer belt 18 is integrally structured in an image formation unit 48, which includes the photosensitive body drum 12, the static charging roller 14 and the secondary-transfer roller 22, in order to achieve a reduction in size of the apparatus while improving maintenance characteristics of the intermediate transfer belt 18, the rotation-type developing apparatus 15 which occupies a large space, and so forth. The image formation unit 48 is structured to be removable by a cover portion of an upper portion of the full-color printer main body 10 opening to allow withdrawal of the whole of the image formation unit 48 to outside the full-color printer main body 10.

The cleaning apparatus 42 for the intermediate transfer belt 18 is provided with a scraper and a cleaning brush (not shown), which are mounted to be controllably movable from a withdrawn position so as to rub against a surface of the intermediate transfer belt 18 at required times. Excess toner and paper dust that are removed by this scraper and cleaning brush are collected to an interior portion of the cleaning apparatus 42.

Now, in this full-color printer main body 10, after completion of the process of transferring a toner image onto the recording paper 24, for one rotation of the photosensitive body drum 12, excess toner and the like is removed from the surface of the photosensitive body drum 12 by a cleaning blade of a cleaning apparatus 35, which is disposed diagonally below the photosensitive body drum 12, so as to prepare the photosensitive body drum 12 for a subsequent image formation process.

The recording paper 24, being the recording medium to which the toner image has been transferred from the intermediate transfer belt 18 as described above, is conveyed along a conveyance path from the secondary-transfer roller 22 to a fixing apparatus 50. The recording paper 24 is conveyed into the fixing apparatus 50, and the toner image is fixed onto the recording paper 24 by pressurization under heating.

A guide member 82, a guide surface of which is curved in an arc-like concave form, is disposed on this conveyance path from the secondary-transfer roller 22 to the fixing apparatus 50 for guiding one face of the recording medium (a face thereof at which the toner image is not formed), mainly by sliding against a leading end portion thereof. Further, this guide member 82 is provided such that the guide surface is disposed at an outer side relative to a straight line L joining a position of nipping of the recording paper 24 by the backup roller 40, which opposes the secondary-transfer roller 22 with the intermediate transfer belt 18 interposed therebetween, with an entrance of a nipping region (the straight line L shown as a broken line in FIG. 1). The nipping region is structured by a pressure pad 56, which opposes a heating roller 52 with a fixing belt 54 interposed therebetween.

The recording paper 24 is conveyed by the nipping region, which is structured by the pressure pad 56 facing the heating roller 52 with the fixing belt 54 interposed therebetween, when the heating roller 52 is driven to rotate. The guide surface of the guide member 82 is disposed as described above and is structured such that, after conveyance of the leading end portion side of the recording paper 24 by the nipping region is commenced, the recording paper 24 will be operated so as not to slide against the guide member 82. Thus, the guide member 82 eliminates sliding noise of the recording paper 24 sliding against the guide member 82.

Specifically, in this structure, at this portion of the conveyance path, a conveyance speed of the nipping region which is structured by the heating roller 52, which nips and conveys the leading end portion side of the recording paper 24, and the pressure pad 56, which faces the beating roller 52 with the fixing belt 54 therebetween, is set to be relatively larger than a conveyance speed of the secondary-transfer roller 22 and the backup roller 40, which faces the secondary-transfer roller 22 with the intermediate transfer belt 18 therebetween, which together nip and convey a trailing end portion side of the recording paper 24.

At the thus-structured conveyance path away from the secondary-transfer roller 22 toward the heating roller 52, the leading end portion of the recording paper 24 that is being conveyed away from the secondary-transfer roller 22 is nipped and conveyed toward the nipping region at the heating roller 52 while sliding against the guide surface of the guide member 82. Then, because the conveyance speed of the nipping region at the heating roller 52 is faster by a required amount and the leading end side of the recording paper 24 is fed more quickly than the trailing end side thereof, the recording paper 24 gradually proceeds into a state in which slackness is removed and the recording paper 24 is stretched linearly and, while being conveyed, the recording paper 24 is moved away from the guide surface of the guide member 82 and enters a state in which sliding noise is not emitted.

Here, it is necessary that the conveyance speed of the nipping region at the heating roller 52 is such that excessive tension is not applied between the leading end being nipped at the heating roller side nipping region and the trailing end being taken out from the secondary-transfer roller side.

Fixing Apparatus

As is shown in FIGS. 1 to 4, the fixing apparatus 50 is structured as a free belt nip fuser-type apparatus, and principal portions thereof are structured by the heating roller 52, which serves as a rotating member which is driven to rotate by a motor, and the pressure pad 56, which is a pressure member which is pressed by the heating roller 52 through the fixing belt 54.

Although not illustrated thus, the heating roller 52 is structured by lamination of a heat-resistant resilient body layer and a separation layer around a core formed of metal (a cylindrical core piece), which is formed in a tubular shape with a predetermined length. The core of the heating roller 52 is structured by a cylindrical body fabricated of a metal with high thermal conductivity, such as iron, aluminum, SUS or the like (here, a thin-wall, high-tensile steel tube is used). Herein, a pressure force of the pressure pad 56 in this fixing apparatus 50 is small. Therefore, with regard to exterior form and wall thickness of the core, a reduction in diameter and a reduction in wall thickness can be achieved.

The heat-resistant resilient body layer of the heating roller 52 may employ any material that is a resilient body with high thermal stability. In particular, resilient bodies such as rubbers, elastomers and the like with rubber hardness of around 25 to 40 degrees (JIS A) can be preferably employed. Specifically, silicone rubbers, fluoride rubbers and the like can be utilized.

The separation layer of the heating roller 52 may use any resin that is a heat-resistant resin. For example, a silicone resin, a fluoride resin or the like can be employed. With regard to separation characteristics and abrasion resistance of the separation layer with respect to toner, fluoride resins are suitable. As a fluoride resin, PFA, PTFE (polytetrafluoroethylene), FEP (a tetrafluoride ethylene-hexafluoride propylene copolymer) or the like can be used. A thickness of the separation layer is preferably from 10 to 50 μm, and more preferably from 10 to 30 μm. If the thickness of the separation layer is less than 10 μm, creasing will be likely to occur at the recording paper 24, in accordance with warping of the heating roller 52. On the other hand, if the thickness is more than 30 μm, the separation layer will be harder, and the possibility of defects such as variations in brightness of images and the like occurring will increase. Thus, neither, of these conditions is preferable.

A halogen lamp is disposed inside the heating roller 52 to serve as a beat source.

A surface of the heating roller 52 is caused to contact a temperature sensor. On the basis of temperature measurement values from this temperature sensor, a control section of the image formation device controls lighting of the halogen lamp and regulates the surface temperature of the heating roller 52 so as to maintain the surface temperature at a predetermined setting temperature of 170° C. In cases in which usual toner is being utilized, this surface temperature of the heating roller 52 must be set to a temperature which is relatively higher, that is, 185° C. However, this image formation device uses "EA toner" (emulsion aggregation toner), so the surface temperature of the heating roller 52 can be lowered 15° C. to 170° C. Because the surface temperature of the heating roller 52 is 15° C. lower in this image formation device, the amount of heat energy that disperses from the heating roller 52 is lowered, which can contribute to rendering a dedicated exhaust fan for the fixing apparatus 50 unnecessary.

For details relating to the static charge development imaging toner that is used in the full-color printer main body 10 which serves as the image formation device of the present embodiment, which is an EA toner (emulsion aggregation toner), and a fabrication method thereof, JP-A No. 2001-255703 is incorporated by reference herein. In particular, in the specification of JP-A No. 2001-255703, refer to the details disclosed in paragraphs 0026 to 0150 for details relating to the static charging development imaging toner, which is the EA toner (emulsion aggregation toner) of the present embodiment, and a fabrication method thereof.

In this fixing apparatus 50, the fixing belt 54 (an endless belt) which is operated to turn synchronously with the heating roller 52 while pressing against the heating roller 52, is formed in an endless ring form (a tubular form with a predetermined length).

This fixing belt 54 is structured as an endless belt, and is constituted by a base layer and a separation layer, which covers the heating roller face of the base layer or both faces of the base layer. The base layer is formed of a polymer such as polyimide, polyamide, polyimide amide or the like, a metal such as SUS, nickel, copper or the like. A thickness of the base layer is around 30 to 200 μm, preferably 50 to 125 μm, and more preferably 75 to 100 μm. The separation layer covering the surface of the base layer is formed of a fluoride resin, for exampler, PFA, PTFE or FEP, and a thickness of the separation layer is around 5 to 100 μm, preferably 10 to 30 μm.

At an inner peripheral face of the fixing belt 54, in order to reduce friction resistance between the fixing belt 54 and the pressure pad 56, a surface roughness Ra (arithmetic mean roughness) is set to not more than 0.4 μm. Furthermore, at an outer peripheral surface of the fixing belt 54, a surface roughness Ra is set to 1.2 to 2.0 μm, so as to facilitate transference of driving force from the heating roller 52.

The fixing belt 54 (endless belt) that is structured thus is supported to be turnable (free to be operated to turn) by the pressure pad 56, which slides against the inner peripheral face of the fixing belt 54, and respective edge guides 58, which support the fixing belt 54 by slidably rubbing against two end portions of the inner peripheral face of the fixing belt 54. Thus, the fixing belt 54 is installed so as to turn with the nipping region, which corresponds with the pressure pad 56, contacting the heating roller 52 with a predetermined, pressure.

The pressure pad 56 is at an inner side of the fixing belt 54, is formed so as to press through the fixing belt 54 against the heating roller 52 with a predetermined distribution of pressing force, and structures the nipping region between the pressure pad 56 and the heating roller 52. Here, the nipping region means a region at which the fixing belt 54 and the heating roller 52 contact while elastically deforming, meaning a region which has a predetermined length in a direction of rotation of the fixing belt 54 and the heating roller 52 (the direction of conveyance of the recording paper 24), spans a longitudinal direction of the fixing belt 54 and the heating roller 52, and has a substantially rectangular shape in a plan view.

The pressure pad 56 is structured by a soft pad member 60, which serves as a pressure member, and a hard pad member 62, which similarly serves as a pressure member. The soft pad member 60 is disposed at a conveyance direction entrance side of the nipping region, guarantees a wide nipping region with respect to the conveyance direction of the recording paper 24 which is the recording medium, and is structured such that the recording paper 24 is heated to reach a predetermined temperature and subjected to a required pressure. The soft pad member 60 may be structured by, for example, a resilient material such as silicone rubber, fluoride rubber or the like, or a plate spring or the like.

Figure 3:
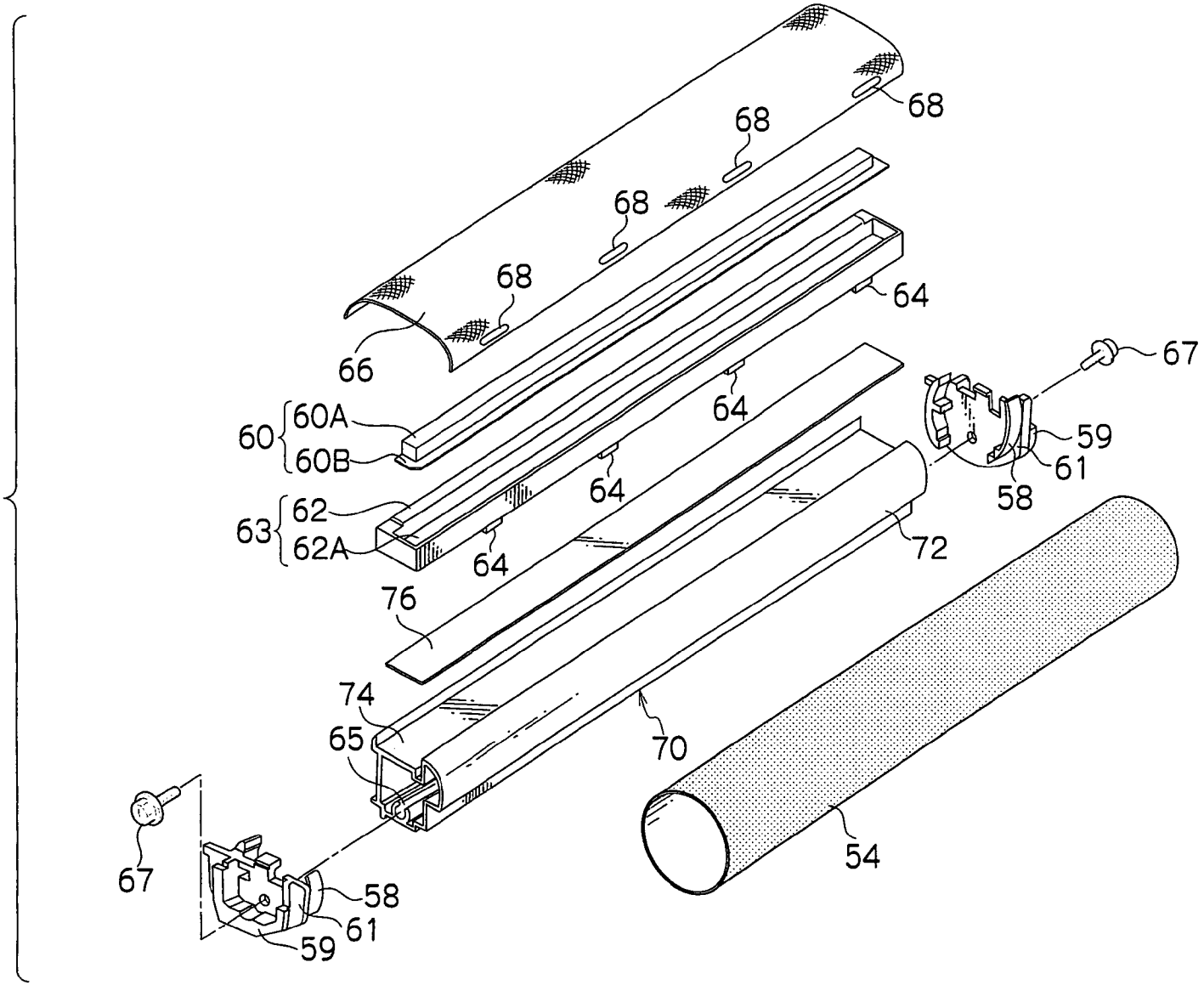
FIG. 3 is an exploded perspective view of the fixing apparatus which is employed in the image formation device relating to the embodiment of the present invention.

In this full-color printer, as shown in FIG. 3, the soft pad member 60 is structured by fixing a reinforcement member 60B, which is formed by a long plate member made of metal, to a bottom face of a resilient material 60A, which is formed in a square column shape. Here, an upper face of the resilient material 60A is formed with a concave form which substantially matches the outer peripheral face of the heating roller 52.

The hard pad member 62 of the pressure pad 56 is disposed at a conveyance direction exit side of the nipping region, and is structured so as to press strongly against the heating roller 52 and cause the heat-resistant resilient body layer and separation layer provided around the core of the heating roller 52 to elastically deform, thus causing the recording paper 24 to separate from the outer surface of the heating roller 52.

This hard pad member 62 may be formed with, for example, a resin with thermal stability, such as PPS (polyphenylene sulfide), polyimide, polyester, polyamide or the like, or a metal, such as iron, aluminium, SUS or the like, as a material thereof. A shape of the hard pad member 62 is formed with an outer face form at the nipping region as a convex curved surface shape (a "kamaboko" shape) with a certain radius of curvature.

As shown in FIG. 3, at this hard pad member 62, an installation portion 62A for the soft pad member 60, which adjoins therewith at a conveyance direction upstream side, is integrally formed along a length direction of the hard pad member 62. Specifically, the hard pad member 62 is partially formed of a pad member main body 63 with a rectangular strip form, and the installation portion 62A for the soft pad member 60 is formed in a rectangular channel form at a location of the hard pad member 62 that neighbors the pad member main body 63.

Hence, a bottom side of the soft pad member 60 fits into the installation portion 62A and is integrally assembled to the installation portion 62A. As a result, the soft pad member 60 and the hard pad member 62 adjoin along the respective length directions thereof, to form the single pressure pad 56.

Small rectangular protrusion-form engagement pieces 64 are respectively provided protruding from the bottom face of the pad member main body 63 at an end portion thereof at an upstream side in the conveyance direction of the recording paper 24, at plural positions which are spaced by predetermined intervals in the length direction of the pad member main body 63. The engagement pieces 64 are for anchoring a low-friction sheet member 66, which is a sliding member.

Figure 2:
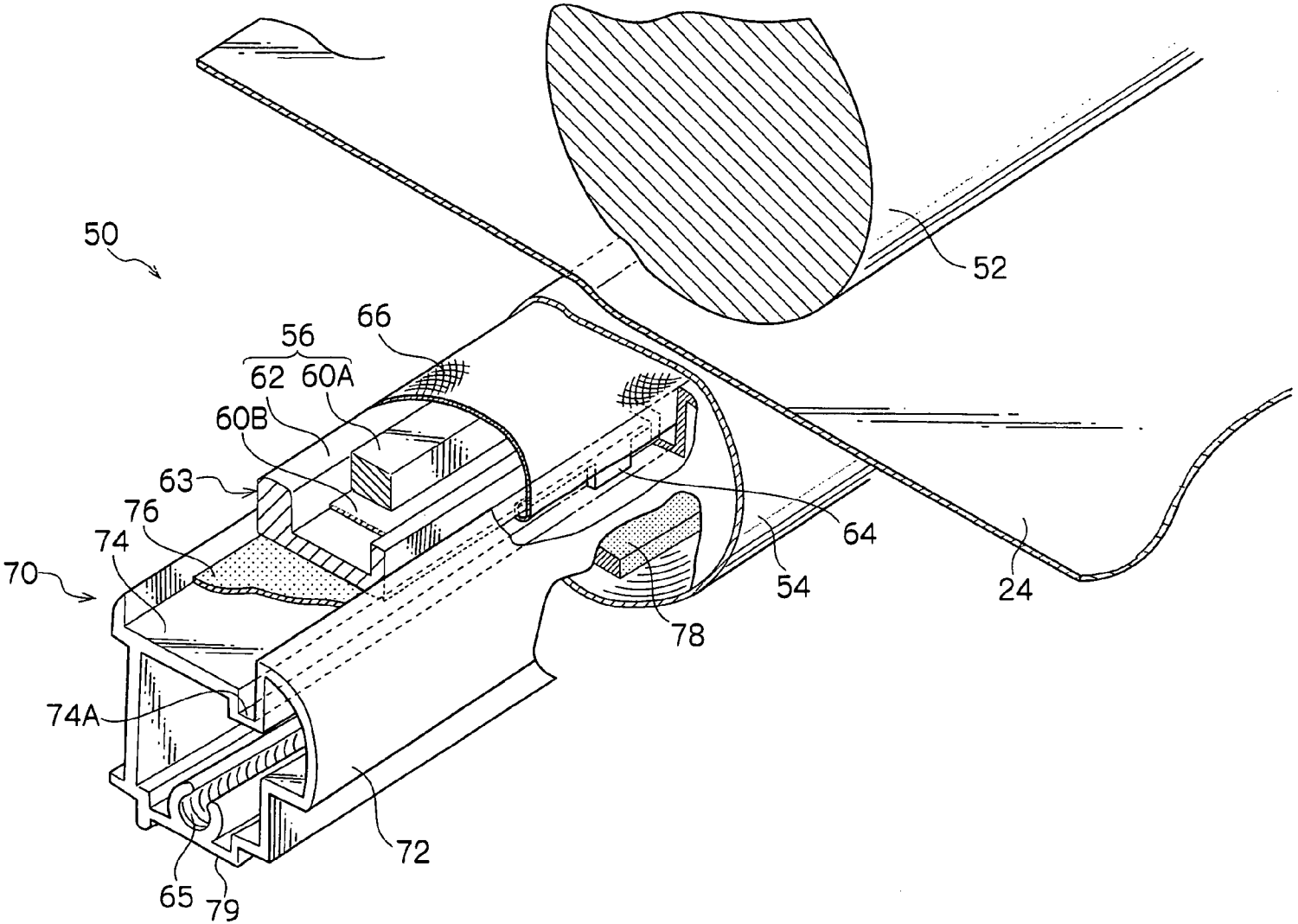
FIG. 2 is a partial sectional perspective view of principal components which shows, in an extracted state, principal components of a fixing apparatus which is employed in the image formation device relating to the embodiment of the present invention.

As shown in FIGS. 2 and 3, this low-friction sheet member 66 is disposed so as to sufficiently cover surfaces of the soft pad member 60 and hard pad member 62 of the pressure pad 56 that correspond with the nipping region. This low-friction sheet member 66 is provided in order to reduce sliding resistance (friction resistance) when the pressure pad 56 slides against the inner peripheral face of the fixing belt 54, with the low-friction sheet member 66 interposed therebetween, in a state in which strong pressing force is being applied. Therefore, the low-friction sheet member 66 is formed in a rectangular shape of a material with a small friction coefficient and excellent abrasion resistance and heat resistance (for example, a sheet formed of a weave of a porous fluoride resin). Herein, if the low-friction sheet member 66 is structured so as to have thermal insulation characteristics, amounts of heat escaping to the pressure pad 56 from the heating roller 52 will be lowered and amounts of heat spreading from the fixing apparatus 50 will be reduced, which can contribute to rendering a dedicated exhaust fan for the fixing apparatus 50 unnecessary.

Further, a surface of the fixing belt side of the low-friction sheet member 66 is formed with indentations and protrusions, such that a lubricant which is applied to the inner peripheral face of the fixing belt 54 will pass into a portion of the low-friction sheet member 66 that slides against the fixing belt 54. These indentations and protrusions are formed with a roughness Ra (arithmetic mean roughness) of, for example, 5 to 30 μm. This is based on the facts that, if the roughness of the indentations and protrusions is less than Ra=5 μm, it will be difficult for enough of the lubricant to pass into the portion that slides against the fixing belt 54, which is not suitable, and on the other hand, if the roughness is greater than Ra=30 μm, tracks of the indentations and protrusions will be apparent as variations in sheen when OHP sheets, coated paper and the like are fixed, which is not preferable. Further still, the low-friction sheet member 66 is structured so as not to be permeable (so as to be difficult to pass through) with respect to the lubricant, such that the lubricant will not permeate in and leak out from a rear face of the low-friction sheet member 66. Further still, for this low-friction sheet member 66, it is possible to employ: a sheet in which a porous resin fiber fabric formed of a fluoride resin serves as a base layer and the heating roller side face of the base layer is wrapped in a PET resin sheet; a sinter-formed PTFE resin sheet; a glass fiber sheet immersed in TEFLON (a registered trademark); or the like.

Engaging holes 68 are respectively formed through this low-friction sheet member 66, at positions corresponding to the respective engagement pieces 64, at vicinities of one end portion extending along the length direction. This one length direction end portion of the low-friction sheet member 66 extends in a straight line form and is structured such that notches, indentations and the like are not formed in portions thereof. Further, in a case in which the low-friction sheet member 66 is structured by a weave, it is desirable if a direction in which one of the threads that weave the fabric (the warp or the weft) is arranged coincides with the length direction of the low-friction sheet member 66, such that a load in a direction intersecting that thread will be borne over the whole of the length direction of that thread The engaging holes 68 that are formed through the low-friction sheet member 66 are formed as through-holes defined by smoothly curved lines, with respective both ends thereof having semi-circular forms, as of regular circles or ellipses, or with other forms which are free of sharp corners and notches, such that the low-friction sheet member 66 will not be torn by concentrations of stress. Further, at the low-friction sheet member 66, a distance from the engaging holes 68 to the length direction one end portion of the low-friction sheet member 66 is set to a required length, and serves as a reinforcing structure to prevent the low-friction sheet member 66 tearing from a region of the engaging holes 68 to the length direction one end portion. Herein, it is also possible to provide a reinforcing structure by increasing the thickness of, or by adopting a two-layer structure of the low-friction sheet member 66 at a region of the low-friction sheet member 66 that extends from the region of the engaging holes 68 to the length direction one end portion, or the like.

The engagement pieces 64 of the pad member main body 63 pass through the respectively corresponding engaging holes 68, and the low-friction sheet member 66 is mounted so as to be wound round the soft pad member 60 to the bard pad member 62. Here, a structure is also possible in which, when the pad member main body 63 is assembled inside an assembly portion 74, as will be described later, a portion of the low-friction sheet member 66 that has been mounted at the pad member main body 63 in this manner, which portion is near the length direction one end portion at which the engaging holes 68 are formed, engages with an engaging structure which retains the low-friction sheet member 66 between a vertical wall of a release groove 74A and a vertical wall of the pad member main body 63 such that a required pressure is applied thereto, such that loads are not concentrated only at the region of the engaging holes 68 of the low-friction sheet member 66.

The pad member main body 63, to which the soft pad member 60 and the low-friction sheet member 66 have been assembled in this manner, is assembled to a holder member 70.

Figure 4:
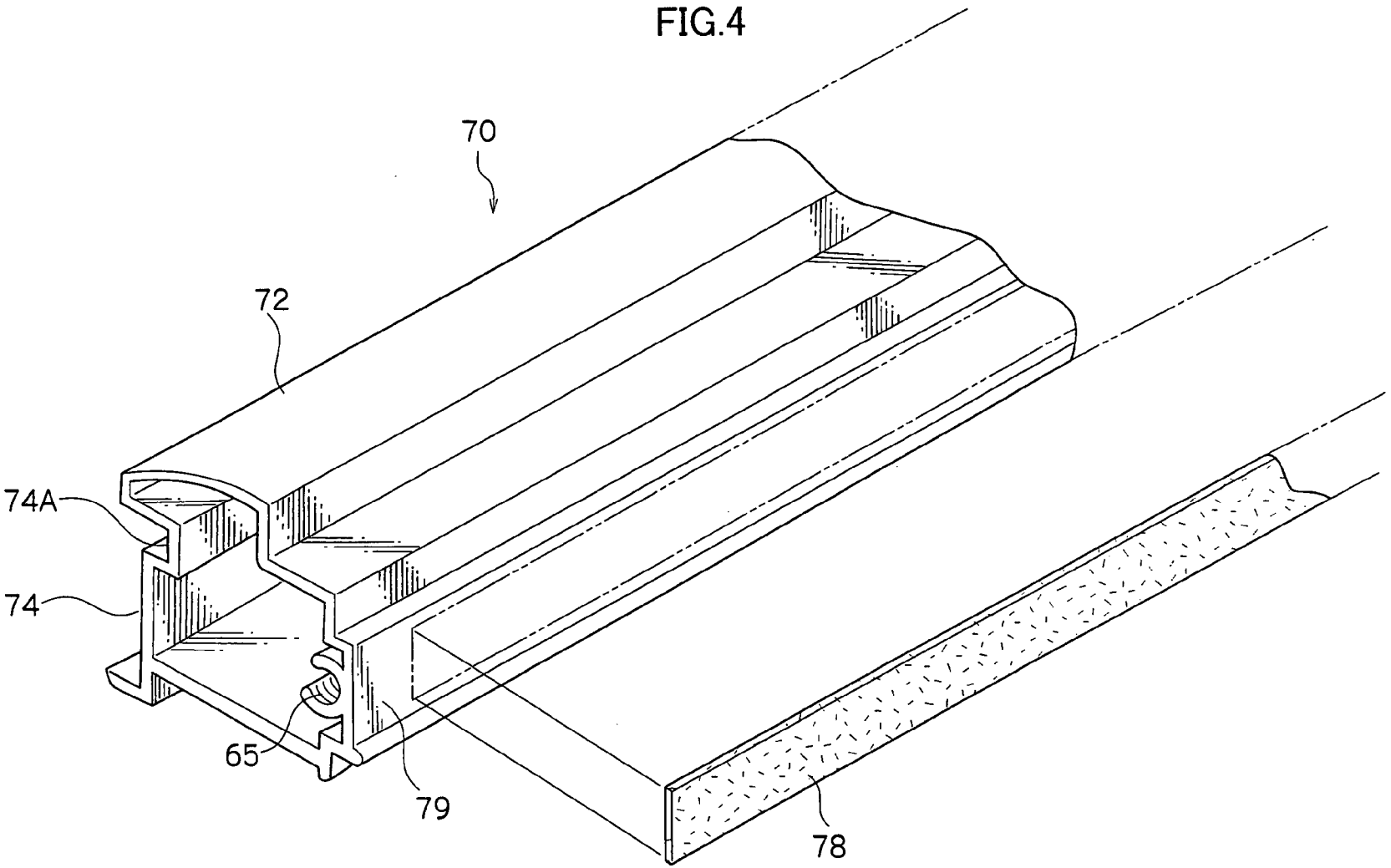
FIG. 4 is an exploded perspective view of principal components of the fixing apparatus which is employed in the image formation device relating to the embodiment of the present invention.

As shown in FIGS. 2 to 4, this holder member 70 is fabricated of a metal such as aluminium or the like, and is formed in a distorted tubular shape at which, in sectional view, a small circular arc shape protrudes from one corner portion of a substantially rectangular shape.

This holder member 70 is disposed with a guide corner portion 72 thereof, at which the small circular arc shape protrudes, oriented to an upstream side of the direction of conveyance of the recording paper 24. Hence, an outer peripheral face of this guide corner portion 72 slides against the inner peripheral face of the fixing belt 54 and guides the turning action thereof.

The assembly portion 74, for the pad member main body 63 and the like, is formed at a side face portion of this holder member 70 that neighbors the guide corner portion 72. This assembly portion 74 is formed as a shallow rectangular channel. The release groove 74A is formed in the assembly portion 74 such that the engagement pieces 64 can be inserted with play therein so as to be adjacent to the guide corner portion 72 therealong.

A resilient sheet member 76 is disposed on a flat placing surface of this assembly portion 74 (a flat surface at a bottom face of the assembly portion 74, excluding the release groove 74A). This resilient sheet member 76 is formed with a resilient material having heat resistance such as, for example, a heat-resistant rubber material or the like. The resilient sheet member 76 is structured in a long plate shape (a strip shape) of a resilient material which absorbs oil without expanding and has excellent heat resistance, being capable of withstanding heat at around 100° C., and which is a resilient material having a rubber hardness which is a hardness (JIS A) of around 30 degrees.

This resilient sheet member 76 is formed with a shape the same as the flat placing surface of the assembly portion 74, with a certain thickness, and is disposed on the flat placing surface of the assembly portion 74.

The resilient sheet member 76 may be provided so as to correspond with regions at which the hard pad member 62 is locally subjected to pressure force. In such a case, the resilient sheet member 76 is structured as one or plural members with shapes corresponding to the regions of the hard pad member 62 which are locally subjected to pressure force, and each member is disposed at a region of the flat placing surface of the assembly portion 74 at which the hard pad member 62 is locally subjected to pressure force.

Further, the resilient sheet member 76 may be disposed only at a bottom face portion of the flat placing surface of the assembly portion 74 that will be directly below the hard pad member 62. Further again, the resilient sheet member 76 may be disposed only at a bottom face portion of the flat placing surface of the assembly portion 74 that will be directly below the hard pad member 62 and the soft pad member 60. Note that the resilient sheet member 76 may also be disposed to span the whole face of the assembly portion 74.

In a case of a structure in which the resilient sheet member 76 is provided so as to thermally insulate between the pad member main body 63 and the holder member 70, amounts of heat escaping from the heating roller 52 through the pad member main body 63 to the holder member 70 will be lowered and amounts of heat spreading from the fixing apparatus 50 will be reduced, which can contribute to rendering a dedicated exhaust fan for the fixing apparatus 50 unnecessary.

As shown in FIGS. 2 to 4, a lubricant application member 78 is provided at the holder member 70, spanning the length direction of an outer side face 79 of a side portion of the holder member 70 that opposes the assembly portion 74. The lubricant application member 78 is structured by a strip of heat-resistant felt, and is impregnated to around 3 g in a lubricant such as, for example, amino-denatured silicone oil with a viscosity of 300 cs or the like. Further, the lubricant application member 78 is disposed so as to make contact with the inner peripheral face of the fixing belt 54 and is structured so as to supply the lubricant to the inner peripheral face of the fixing belt 54 continuously in appropriate quantities, by osmosis from the heat-resistant felt. Herein, the lubricant application member 78 is desirably formed such that only an edge portion of the heat-resistant felt makes contact with the inner peripheral face of the fixing belt 54, such that the supply of lubricant from the heat resistant felt will not be excessive. Accordingly, the lubricant is applied to a portion of sliding between the fixing belt 54 and the low-friction sheet member 66, sliding resistance between the pressure pad 56 and the fixing belt 54, via the low-friction sheet member 66, is further reduced, and smooth operation of the fixing belt 54 is expected.

The two end portions of the inner peripheral face of the fixing belt 54 that slides on the pressure pad 56 in this manner are rotatably (to be free to be operated to turn) supported by the respective edge guides 58. In sectional view, these edge guides 58 are provided at an outer side of belt running guide members 59, which are formed in substantial "C" shapes. In order to greatly reduce sliding resistance and lessen heat damage, the belt running guide members 59 are formed of a material with low thermal conductivity whose coefficient of static friction is small. Further, flange portions 61 are formed at the belt running guide members 59. These flange portions 61 are protrudingly provided so as to extend out further to an outer side of the edge guides 58 than an internal radius of the fixing belt 54.

The belt running guide members 59 close off both end portions of the holder member 70 by respective screw parts 67 of the belt running guide members 59 fitting into a screw hole 65, which is formed inside a tubular hole of the holder member 70.

At the fixing apparatus 50, a gap between relatively opposing inner side faces of the flange portions 61 of the belt running guide members 59, which have been respectively assembled to the two end portions of the holder member 70, is set so as to substantially match a width of the fixing belt 54, to regulate displacement of the fixing belt 54 in the width direction thereof (belt walking).

At this fixing apparatus 50, a guide member 110 for the recording paper 24, which serves as an exterior component, is provided at a conveyance direction downstream side relative to the nipping region formed between the beating roller 52 and the fixing belt 54. In addition, conveyance rollers 112, for conveying the recording paper 24 that has been fixing-processed, are provided at an exit position in a vicinity of a conveyance direction downstream side of this guide member 110.

Figure 6:
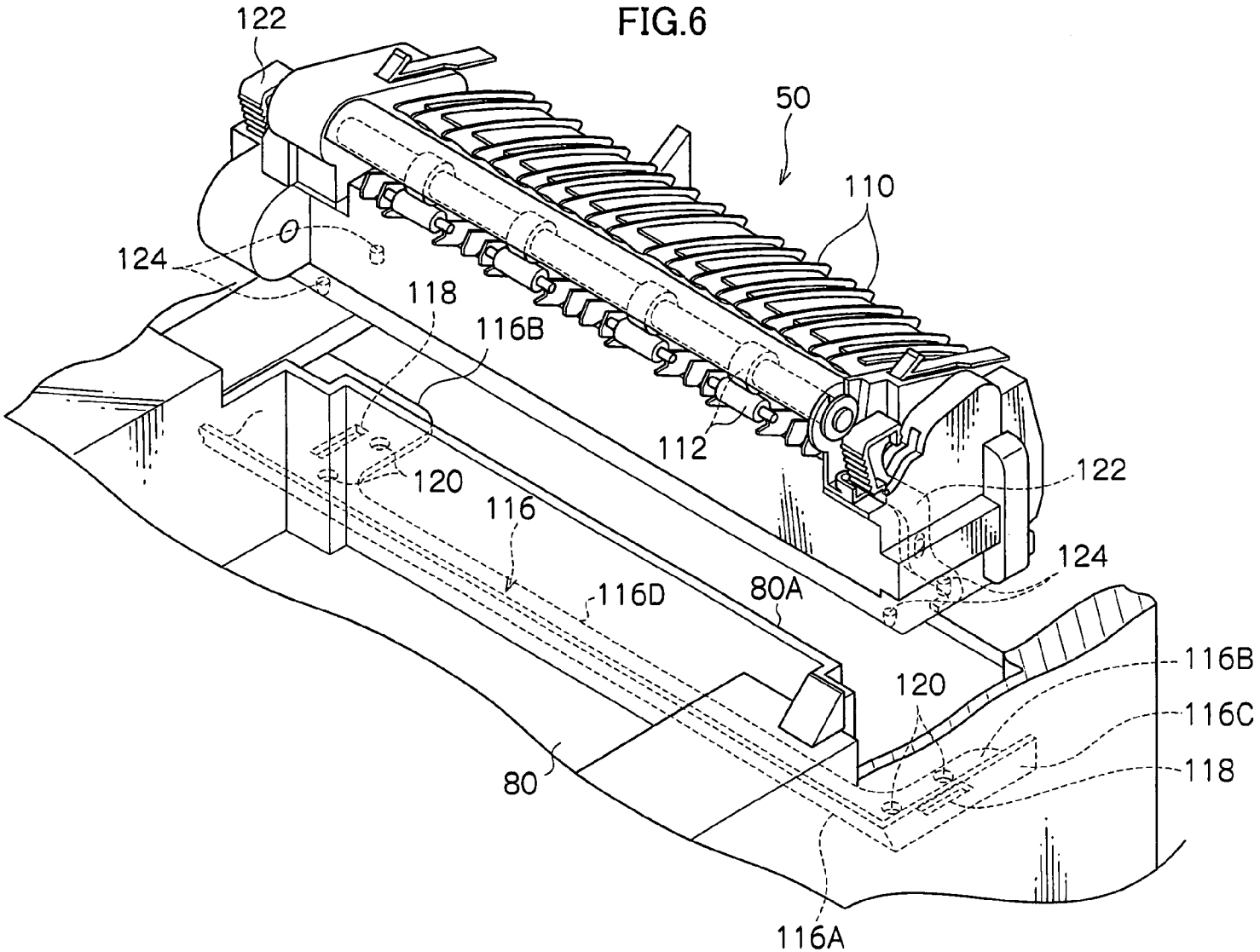
FIG. 6 is an exploded perspective view of principal components which shows, in an extracted state, portions of the fixing unit mounting portion and the fixing apparatus of the image formation device relating to the embodiment of the present invention.

As shown in FIG. 6, the fixing apparatus 50 is configured to serve as an individual apparatus unit which is mountable at and removable from the full-color printer main body 10. In order to structure the full-color printer main body 10 with a fanless ventilation structure in which an exhaust fan is not provided for facilitating removal of hot air from the interior of the full-color printer main body 10, this fixing apparatus 50 structured as an individual apparatus unit is disposed in a corner region along one edge of an upper portion of a housing 114, which structures the exterior of the full-color printer main body 10. With this full-color printer main body 10, because it is possible to cool the fixing apparatus 50, which releases the greatest amounts of heat, without an exhaust fan, it is possible that no exhaust fan will be required for cooling other equipment provided in the housing 114. Thus, it is possible to structure the full-color printer main body 10 with a completely fanless ventilation structure in which no exhaust fans at all are provided in the whole of the full-color printer main, body 10.

In this full-color printer main body 10, the full-color printer main body is formed with a substantially rectangular exterior profile, and the fixing apparatus 50 structured as an individual apparatus unit is removably mounted in a fixing unit mounting portion, which is provided at an inner side of a corner portion along a rear end side of the upper portion of the full-color printer main body.

Figure 5:
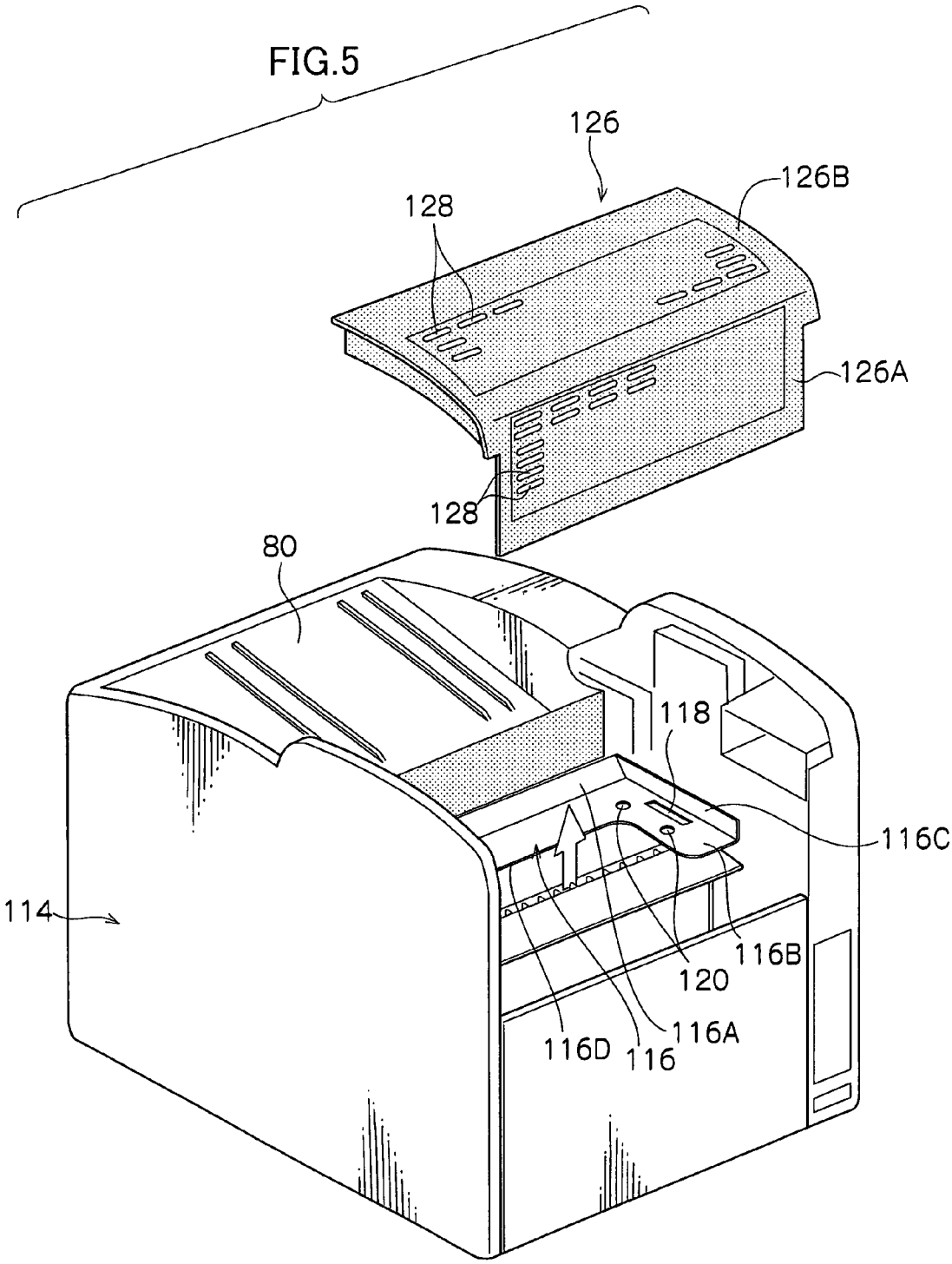
FIG. 5 is a perspective view showing disassembly of principal components of a fixing unit mounting portion of the image formation device relating to the embodiment of the present invention.

As is shown in FIGS. 1, 5 and 6, this fixing unit mounting portion is structured by a partition wall 80A and a heat shielding member 116 so as to define a substantial "L" shape which opens toward an upper face and a rear face, which is one of vertical faces of the housing 114, so as to enable isolation such that hot air will not flow to equipment inside the housing 114. The partition wall 80A is provided to be oriented in a vertical direction inside the housing 114 of the full-color printer main body 10. The heat-shielding member 116 closely contacts and joins with a lower end portion of the partition wall 80A so as to extend horizontally therefrom.

At this full-color printer main body 10, the partition wall 80A is structured to also function as a rear plate which is integrally formed to stand upright from a bottom face of an ejection tray 80, which is fabricated of plastic.

Further, the heat-shielding member 116 is provided in a state of being oriented extending from a side face of the partition wall 80A, and is structured to also function as a support member for supporting the fixing apparatus 50, which structures the individual apparatus unit, to be removable. This heat-shielding member 116 is fabricated of metal and is formed in a substantial "U" shape in plan view, with protruding side portions 116B at the two ends thereof. Engaging holes 118 and positioning holes 120 are respectively formed through the protruding side portions 116B.

At the heat-shielding member 116, an edge portion 116A along the partition wall 80A is inflected to turn diagonally upward. This edge portion 116A which is oriented diagonally upward is oriented so as to abut against the side face of the partition wall 80A. Thus, the heat-shielding member 116 is structured such that hot air is prevented from flowing back into the housing 114 between the partition wall 80A and the edge portion 116A. Further at the heat-shielding member 116, respective outer side edge portions of the two protruding side portions 116B are perpendicularly inflected to form vertical wall portions 116C, which stand upright. Thus, the heat-shielding member 116 is structured so as to prevent hot air from flowing back into the housing 114 between the vertical wall portions 116C of the heat-shielding member 116 and two side portions of the housing 114.

Further yet at the heat-shielding member 116, a conveyance path-facilitating portion 116D is cut away so as to be indented into a flat face portion between the protruding side portions 116B. The conveyance path-facilitating portion 116D is provided at a vicinity of a vertical conveyance path of the recording paper 24, which extends in a vertical direction away from the secondary-transfer roller 22 to the heating roller 52. This vertical conveyance path serves as a passage portion which allows recording mediums to pass from below to above the fixing unit.

The fixing apparatus 50 structured as the individual apparatus unit is mounted at the fixing unit mounting portion, on the heat-shielding member 116 which is structured as described above. Hook members 122 are respectively attached to two length direction end portions of the fixing apparatus 50, and distal end hooked portions of these hook members 122 are engaged with the respectively corresponding engaging holes 118, to removably mount the fixing apparatus 50. Further, two positioning pins 124 are provided protruding from predetermined positions of the two ends of the fixing apparatus 50. The fixing apparatus 50 is positioned to be disposed at a predetermined position on the heat-shielding member 116 by the positioning pins 124 fitting into the respective positioning holes 120 of the heat-shielding member 116.

In other words, a shielding portion which is structured at the fixing unit mounting portion is formed to span from a lower face side of the fixing unit to another side face side of the fixing unit, which is opposite from one side face side of the fixing unit, and the shielding portion is structured so as to form a partition wall inside the housing 114 of the full-color printer main body 10.

Of the fixing apparatus 50 that is attached to the fixing unit mounting portion in this manner, a rear face, which is one of vertical faces of the fixing apparatus 50 and an upper face are covered by a cover member 126. This cover member 126 corresponds to the corner portion of the rear face side of the housing 114, and is formed by integrating a side face portion 126A, which covers the rear face side portion, and a level face portion 126B, which covers the upper face, in an inflected form in side view. Thus, the cover member 126 is structured with a shape corresponding to the corner portion along the one edge of the upper portion of the housing 114.

Further, at the cover member 126, respective pluralities of ventilation apertures 128 are formed through at least the side face portion 126A (a lower portion of the cover member 126) and the level face portion 126B (an upper portion of the cover member), to serve as apertures which are formed in respective predetermined rectangular ranges, which are specified so as to correspond with the whole length direction length of the fixing apparatus 50. These ventilation apertures 128 formed in the side face portion 126A and the level face portion 126B utilize the characteristic of hot air rising to achieve natural ventilation of a cavity interior portion surrounded by the partition wall 80A, the heat-shielding member 116 and the cover member 126. That is, the fixing apparatus 50 is cooled by air that enters through all the ventilation apertures 128 in the side face portion 126A coming into contact with the fixing apparatus 50 along the whole length direction length thereof and performing heat exchange. Air that is warmed in this manner rises and is exhausted uniformly from all the ventilation apertures 128 formed in the level face portion 126B, which span the length direction of the fixing apparatus 50. Thus, this structure can produce highly efficient flows of air.

In addition, air in the cavity interior portion surrounded by the partition wall 80A, the heat-shielding member 116 and the cover member 126 can be forcibly ventilated by utilizing the action of the recording paper 24 that is being fixing-processed by the fixing apparatus 50. That is, when the recording paper 24 is being conveyed form the secondary-transfer roller 22 into the fixing apparatus 50, a rising airflow which accompanies the action of the recording paper 24 rising along the vertical conveyance path is generated across the whole width direction length of the recording paper 24. This airflow comes into contact with the fixing apparatus 50 across the whole length direction thereof and cools the fixing apparatus 50. Air that has been warmed in this manner rises and is exhausted uniformly from all the ventilation apertures 128 formed in the level face portion 126B, which span the length direction of the fixing apparatus 50. Thus, this structure produces a highly efficient flow of air. Note that, in such a case, a portion of the warmed air may be exhausted uniformly through the ventilation apertures 128 formed in the side face portion 126A, which span the length direction of the fixing apparatus 50.

Because the air in the cavity interior portion that is surrounded by the partition wall 80A, the heat-shielding member 116 and the cover member 126 can be efficiently ventilated as described above by natural convection and by the forced convection which accompanies the conveyance operation of the recording paper 24, the fixing apparatus 50 that is disposed in this cavity interior portion can be sufficiently ventilated. Therefore, it is possible to eliminate the necessity for provision of an exhaust fan in the full-color printer main body 10, to cut out a number of components relating to an exhaust fan, and to provide a product whose cost is correspondingly lower.

When air that has been used for cooling the fixing apparatus 50 disposed in the cavity interior portion surrounded by the partition wall 80A, the heat-shielding member 116 and the cover member 126 is being ventilated, the heated air which is exhausted from the cavity interior portion includes noxious components which are generated during heating and fixing of the toner. This air is dispersed and exhausted uniformly from all of the ventilation apertures 128 spanning the length direction of the fixing apparatus 50 and is rapidly mixed with air outside the cover member 126, and the noxious components are rapidly dispersed and diluted. Thus, it is possible to avoid the sensing of unpleasant odors in the vicinity of this full-color printer main body 10.

Next, a basic image creation process of the full color printer, which is an image formation device equipped with a fixing apparatus for an electrophotography system, will be described in relation to the present embodiment.

At the full-color printer shown in FIG. 1, image data is outputted from an unillustrated image acquisition device (IIT), an unillustrated personal computer (PC) or the like. Predetermined image processing is applied to the image data by an unillustrated image processing system (IPS), after which an image creation operation is executed by the developing apparatus 15 (the developers 15Y, 15M, 15C and 13K). In this image processing system (IPS), predetermined image processings such as shading correction, mispositioning correction, brightness/color space conversion, gamma correction, frame deletion, various types of image editing such as color editing, movement editing and suchlike, and the like are applied to inputted reflectivity data. The image data on which image processing has been carried out is converted to color-level data of the four colors Y, M, C and K, and is outputted to the ROS 16, which is a laser exposure device.

At the ROS 16, a laser beam LB emitted from, for example, a semiconductor laser in accordance with the inputted color level data is irradiated at the photosensitive body drum 12 of the image formation unit 48. At the photosensitive body drum 12, after the surface has been charged by the static charging roller 14, the surface is scanned and exposed by the ROS 16 to form an electrostatic latent image.

The electrostatic latent image that has been formed on the surface of the photosensitive body drum 12 is developed by the rotary-type developing apparatus 15, at which the developers 15Y, 15M, 15C and 15K of the colors yellow (Y), magenta (M), cyan (C) and black (K) are arranged along the circumferential direction. Thus, toner images corresponding to the colors yellow (Y), magenta (M), cyan (C) and black (K) are sequentially formed. When one of the toner images that are sequentially formed on the photosensitive body drum 12 in this manner passes through the primary-transfer position, the toner image is primary-transferred onto the intermediate transfer belt 18 in a condition such that the toner images are superposed with one another.

Then, the yellow (Y), magenta (M), cyan (C) and black (K) toner images that have been superposedly transferred onto the intermediate transfer belt 18 are secondary-transferred by the secondary-transfer roller 22, all at the same time, onto the recording paper 24 which serves as the recording medium.

The recording paper 24 to which the toner images have been transferred from the intermediate transfer belt 18 in this manner is conveyed into the fixing apparatus 50.

While the recording paper 24 to which this toner image has been transferred from the intermediate transfer belt 18 is being conveyed to the fixing apparatus 50, the leading end side of the recording paper 24 is fed more quickly than the trailing end side, slackness is removed, and the recording paper 24 gradually proceeds to a state of being linearly tensed while being conveyed. In the state in which the recording paper 24 is separated from the guide face of the guide member 82 and is not emitting sliding noise, the recording paper 24 is conveyed along the vertical conveyance path in a suitable condition, being stretched by at least a predetermined amount or being free of slackness. At this time, air around the recording paper 24 is caused to rise so as to come into contact with the fixing apparatus 50, to cool the fixing apparatus 50 while the recording paper 24 is being conveyed.

At the fixing apparatus 50, the heating roller 52 is rotated in the direction of arrow B by an unillustrated driving motor. The fixing belt 54 also turns, following this rotation, and the recording paper 24 to which the toner image has been electrostatically transferred is conveyed into the nipping region, which is the location between the heating roller 52 and the pressure pad 56. Then, while the recording paper 24 is passing through the nipping region, the toner image on the recording paper 24 is fixed, by pressure forces that act in the nipping region and heat which is supplied from the heating roller 52.

At this fixing apparatus 50, the air in the cavity interior portion, which is surrounded by the partition wall 80A, the heat-shielding member 116 and the cover member 126, is suitably cooled by the natural convection and by the forced convection that accompanies the conveyance operation of the recording paper 24.

Furthermore, at this fixing apparatus 50, because a structure is possible in which the nipping region is broadened by the recess-form soft pad member 60, which substantially matches the outer peripheral face of the heating roller 52, it is possible to assure a consistent fixing function. In addition, at this fixing apparatus 50, warping of the surface layer of the heating roller 52 is locally increased at an exit region (a separation nipping portion) of the nipping region by the hard pad member 62, which is protruded so as to dig in to the outer peripheral face of the heating roller 52. Therefore, when the recording paper 24 which has been fixing-processed is passing through the separation nipping portion, the recording paper 24 passes through this warping which is locally formed to be large, and the recording paper 24 is reliably separated rather than wrapping onto the heating roller 52. That is, it is possible to locally increase the warping of the heating roller 52 with the hard pad member 62, and thus provide high peeling functionality with a small amount of warping. Therefore, even if a thin film of a heat-resistant resin is employed as the separation layer of the heating roller 52, occurrences of creasing of the recording paper 24 can be suppressed. Moreover, separation of the separation layer from the heat-resistant resilient body layer or the like is less likely to occur, and it is possible to both maintain peeling functionality and improve reliability of component characteristics over long periods.

Further again, because the amount of warping of the heating roller 52 can be formed to be small, the heat-resistant resilient body layer of the heating roller 52 can be made thinner. As a consequence, the heating roller 52 can be structured to have a smaller thermal capacity, warm-up times can be shortened, and a reduction in electricity consumption can be expected. Further still, because the heat-resistant resilient body layer with low thermal conductivity can be made thinner, thermal resistance between an inner face and the outer face of the heating roller 52 can be reduced and an improvement in thermal responsiveness can be expected, which is suitable for increasing speed of the image formation device.

Further yet, in the fixing apparatus 50 relating to the present embodiment, the pad member main body 63 is mounted to the assembly portion 74 of the holder member 70 with the resilient sheet member 76 interposed therebetween. Consequently, in this fixing apparatus 50, when a strong load is locally applied to the hard pad member 62, a portion of the pad member main body 63 elastically deforms locally at a region of the bard pad member 62 that is subjected to the strong load (i.e., locally deforms so as to squash the resilient sheet member 76), and the load is dispersed so as not to be concentrated.

Thus, in a case of fixing processing of a recording medium whose thickness is locally thicker (for example, an envelope or the like) by this fixing apparatus 50, when a locally thicker portion of the recording medium is passing through the nipping region at the location between the heating roller 52 and the hard pad member 62, a large load is applied where the locally thicker portion of the recording medium passes over the hard pad member 62. Accordingly, the hard pad member 62 causes the resilient sheet member 76 to elastically deform at a region at which this large load is applied and to elastically deform away from the load by locally warping so as to be recessed in a direction away from the heating roller 52. Consequently, the hard pad member 62 exerts a load evenly over a whole length, in the length direction of the hard pad member 62, of a region at which the load is applied, and a distribution of the load in the length direction of the hard pad member 62 is kept in a tolerable range. Thus, proper fixing processing is enabled (i.e., fixing processing without, for example, the recording paper 24 becoming wrinkled, the surface of the heating roller 52 becoming wrinkled due to plastic deformation, or the like).

At this fixing apparatus 50, the toner image is fixed to the recording paper 24 by the recording paper 24, to which the toner image has been electrostatically transferred, passing through the nipping region as described above. A conveyance force when the recording paper 24 is passing through the nipping region is received from the heating roller 52 at a driving side. To be specific, the recording paper 24 is conveyed by being subjected to frictional force from the heating roller 52 in accordance with rotation of the heating roller 52. Accordingly, when the recording paper 24 is passing through the nipping region, the recording paper 24 is subjected to conveyance force from the heating roller 52, and is subjected to a force from the fixing belt 54 in a direction opposite to the conveyance direction (a counter-conveyance force).

Here, because the fixing belt 54 is pressed against the hard pad member 62 in the nipping region, the fixing belt 54 is subjected to a force from the pressure pad 56 in a direction opposite to the direction of rotation, which force acts as frictional resistance. Accordingly, as described earlier, the low-friction sheet member 66 is interposed between the fixing belt 54 and the hard pad member 62, and lubricant is applied to the inner peripheral face of the fixing belt 54 from the lubricant application member 78. With this structure, frictional resistance between the fixing belt 54 and the hard pad member 62 is greatly reduced.

Therefore, in usual conditions, the frictional resistance that the fixing belt 54 experiences from the hard pad member 62 is greatly lowered, and the fixing belt 54 can turn smoothly. As a result, it is possible for the fixing belt 54 to turn at a speed equal to the speed of the recording paper 24. In such a case, because the counter-conveyance force that the recording paper 24 is subjected to is fictional resistance from the hard pad member 62 via the fixing belt 54, the counter-conveyance force is at a low level such that the counter-conveyance force can be disregarded. Consequently, the recording paper 24 is conveyed while turning in contact with the heating roller 52.

Herein, the lubricant application member 78 is disposed so as to contact the inner peripheral face of the fixing belt 54, and continuously supplies a lubricant, such as amino-denatured silicone oil or the like, to the inner peripheral face of the fixing belt 54. Note that the lubricant is not limited thus. Any lubrication oil or the like that is commonly used and that has a required viscosity (for example, from a viscosity of 100 cs to a viscosity of 350 cs) can be suitably utilized.

Moreover, a function is also included for recovery of the lubricant that has been applied to the inner peripheral face of the fixing belt 54 when the fixing belt 54 turns to return to the location at which the lubricant application member 78 is disposed. Hence, because the lubricant application member 78 performs recovery and supply of the lubricant at the inner peripheral face of the fixing belt 54 simultaneously, the lubricant is continuously applied in constant amounts, and an amount of lubricant retained at the lubricant application member 78 is kept constant.

The fixing belt 54 which is coated with lubricant by this lubricant application member 78 is rotated and conveyed to the nipping region. Under the pressure force between the hard pad member 62 and the fixing belt 54 at the nipping region, because the tiny indentations and protrusions are formed at the fixing belt side face of the low-friction sheet member 66, a large proportion of the lubricant that has been applied to the fixing belt 54 enters into the indentation portions of the low-friction sheet member 66, and is supplied to the portion of sliding between the low-friction sheet member 66 and the fixing belt 54. Thus, circulatory utilization of the lubricant that is applied to the inner peripheral face of the fixing belt 54 can be maintained, and the fixing belt 54 can be turned smoothly over long periods. As a result, a lifespan of the fixing apparatus 50 extends over a long period, and it is possible to suppress occurrences of paper creasing, paper jams and the like.

The recording paper 24 at which, as described above, the toner image has been fixed and image formation completed at the fixing apparatus 50 is conveyed out from the fixing apparatus 50, as shown in FIG. 1, and is ejected to and collected on the ejection tray 80, which is provided at the upper portion of the full-color printer main body 10.

Obviously, the present invention can assume various other structures within a scope that does not depart from the spirit of the present invention.

In the image formation device of the present invention the heat-shielding member may be fabricated of metal.

According to a structure as described above, with a heat-shielding member made of metal it is possible to further improve a thermal insulation effect which prevents heat energy transferring away from the fixing apparatus in the fixing unit mounting portion toward other equipment in the housing.

Further, in the image formation device of the present invention, the toner that is fixed to the recording medium may be an emulsion aggregation-type toner.

With a structure as described above, in addition to the operations and effects of the invention described above, when a recording medium bearing an image of emulsion aggregation toner is to be heated and pressured for fixing processing, a heating temperature of the fixing apparatus can be set lower. Therefore, amounts of heat spreading from the fixing apparatus can be reduced, and sufficient cooling of the fixing apparatus is possible even without an exhaust fan.

Further again, in the image formation device of the present invention, a shielding portion may be formed with a heat-shielding member which supports the fixing unit at the printer main body and blocks the hot air that spreads from the fixing unit.

Further yet, in the image formation device of the present embodiment, the shielding portion may be formed with a heat-shielding member which supports the fixing unit at the printer main body and blocks the hot air that spreads from the fixing unit, and a partition wall which constitutes a portion of an ejection tray, to which the recording medium to which the toner image has been fixed is ejected.

In the image formation device of the present invention, the heat-shielding member preferably includes a conveyance path-facilitating portion, through which the recording medium bearing the toner image passes.

What is claimed is:

1. An image formation device at which a fixing apparatus that heats and pressurizes a recording medium, which bears a toner image, for fixing the toner image is disposed inside a housing of a printer main body and is configured in a fanless ventilation structure, the image formation device comprising:

a fixing unit mounting portion, which is structured at an inner side of a corner portion along one side of an upper portion of the housing, the fixing unit mounting portion being surrounded by a partition wall and a heat-shielding member, which is oriented so as to extend from a side face of the partition wall, the fixing apparatus being placed on the heat-shielding member, and the fixing unit mounting portion being isolated such that hot air will not flow to other equipment inside the housing;

a cover member for covering the fixing unit mounting portion, the cover member structuring an exterior form corresponding to the corner portion along the one side of the upper portion of the housing;

a ventilation portion which includes ventilation apertures formed through at least an upper portion and a lower portion of the cover member to span ranges which respectively correspond to a whole length of fixing apparatus in a length direction thereof; and a conveyance portion for the recording medium, which is provided in a vicinity of a conveyance path-facilitating portion, which is a portion of one side of the heat-shielding member.

2. The image formation device of claim 1, wherein the heat-shielding member is fabricated of metal.

3. The image formation device of claim 1, wherein the toner to be fixed to the recording medium comprises emulsion aggregation toner.

4. An image formation device at which a fixing apparatus which heats and pressurizes a recording medium, which bears a toner image, for fixing the toner image is provided as a fixing unit, which is removable from a printer main body, inside a housing of the printer main body, the image formation device comprising:

a cover member which structures a portion of the housing and covers an upper face side of the fixing unit and one side face side of the fixing unit;

a ventilation portion which includes apertures formed in each of the upper face side and the one side face side of the cover member to span a length direction of the fixing unit;

a shielding portion which is formed to span from a lower face side of the fixing unit to another side face side of the fixing unit, which is opposite from the one side face side thereof, and forms a partition wall inside the housing of the printer main body; and a passage portion which allows the recording medium to pass through from below to above the fixing unit.

5. The image formation device of claim 4, wherein the shielding portion comprises a heat-shielding member which supports the fixing unit at the printer main body and blocks hot air which spreads from the fixing unit.

6. The image formation device of claim 5, wherein the heat-shielding portion comprises a conveyance path-facilitating portion through which the recording medium bearing the toner image passes.

7. The image formation device of claim 4, wherein the shielding portion comprises a heat-shielding member, which supports the fixing unit at the printer main body and blocks hot air which spreads from the fixing unit, and a partition wall which constitutes a portion of an ejection tray, to which the recording medium to which the toner image has been fixed is ejected.

8. An image formation device comprising:

a housing which structures an exterior form of a printer main body;

a fixing unit mounting portion which is structured at an inner side of a corner portion along one side of an upper portion of the housing, the fixing unit mounting portion including a partition wall and a heat-shielding member, which extends from a side face of the partition wall;

a removable fixing unit which is placed on the heat-shielding member inside the housing, the fixing unit heating and pressurizing a recording member which bears a toner image for fixing the toner image;

a cover member which structures a portion of the housing and includes an upper face which covers an upper face of the fixing unit and a side face which covers one side face of the fixing unit;

a ventilation portion which includes a plurality of apertures formed in each of the upper face and the one side face of the cover member to span a length direction of the fixing unit; and a passage portion which allows the recording medium to pass through from below to above the fixing unit.

9. The image formation device of claim 8, wherein the heat-shielding member is fabricated of metal.

10. The image formation device of claim 8, wherein the toner to be fixed to the recording medium comprises emulsion aggregation toner.

11. The image formation device of claim 8, wherein the heat-shielding member blocks hot air which spreads from the fixing unit, and the partition wall constitutes a portion of an ejection tray, to which the recording medium to which the toner image bas been fixed is ejected.

12. The image formation device of claim 8, wherein the heat-shielding portion comprises a conveyance path-facilitating portion through which the recording medium bearing the toner image passes.

13. The image formation device of claim 8, wherein the fixing unit comprises:

a rotating member which is driven to rotate;

a fixing belt which rotates synchronously with the rotating member, and a pressure member which presses against the rotating member through the fixing belt, and wherein the toner image is fixed to the recording medium when the recording medium bearing the toner image is passing through a nipping region which is structured by the pressure member opposing the rotating member through the fixing belt.

14. The image formation device of claim 13, wherein the fixing unit includes a low-friction sheet member which has thermal insulation characteristics, and the low-friction sheet member is disposed so as to cover a surface of the pressure member that corresponds to the nipping region.

15. The image formation device of claim 13, wherein the fixing unit includes a metallic tube-form holder member and a resilient sheet member, which is disposed between the holder member and the pressure member, and the resilient sheet member provides thermal insulation between the holder member and the pressure member.

16. The image formation device of claim 13, wherein the rotating member comprises a heat source and a temperature sensor, and is regulated such that a surface of the rotating member maintains a predetermined temperature.

17. The image formation device of claim 8, wherein an end side portion of the heat-shielding member along the partition wall is inflected to be oriented diagonally upward, and an end of the diagonally upward-oriented end side portion abuts against the side face of the partition wall.

18. The image formation device of claim 17, wherein end side portions at two sides of the heat-shielding member, which neighbor the side along the partition wall, are inflected perpendicularly upward to form vertical end portions, and flows of hot air between the vertical end portions of the heat-shielding member and the housing are prevented by the vertical end portions.

* * * * *